US008272709B2

(12) United States Patent
Llado et al.

(10) Patent No.: US 8,272,709 B2
(45) Date of Patent: Sep. 25, 2012

(54) REDUCING VERTICAL BANDING

(75) Inventors: David Gaston Llado, Barcelona (ES); Valery Risson, Barcelona (ES); Oriol Borrell Avila, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 301 days.

(21) Appl. No.: 12/760,774

(22) Filed: Apr. 15, 2010

(65) Prior Publication Data

US 2011/0254886 A1 Oct. 20, 2011

(51) Int. Cl.
*B41J 29/38* (2006.01)

(52) U.S. Cl. ..... 347/14; 347/37; 347/16

(58) Field of Classification Search ..... 347/12, 347/14, 15, 16, 19, 40, 41, 43, 5, 104, 105
See application file for complete search history.

(56) References Cited

U.S. PATENT DOCUMENTS

| | | | | |
|---|---|---|---|---|
| 6,565,171 | B2 * | 5/2003 | Miquel et al. | 347/5 |
| 6,595,621 | B2 | 7/2003 | Castano et al. | |
| 6,629,751 | B2 | 10/2003 | Giere et al. | |
| 6,935,795 | B1 | 8/2005 | Fagan et al. | |
| 7,364,262 | B2 | 4/2008 | Quintana et al. | |
| 2010/0033541 | A1 | 2/2010 | Stevenson et al. | |

OTHER PUBLICATIONS

Epson Stylus Pro 4800 and EFI Offset Proof 9200 Semimatt Paper How to Prevent Vertical Banding, CPA Search, Jan. 28, 2010.
Mutoh Unveils "Intelligent Interweaving" Print Technology for Spitfire & Rockhopper 3 Printer Series, CPA Search, Nov. 29, 2006.

* cited by examiner

*Primary Examiner* — Juanita D Jackson

(57) ABSTRACT

A method for reducing vertical banding of a printed image, the method performed by a control system associated with a printer, the method includes, with the control system, adjusting the spacing between which ink droplets are fired from ink nozzles of the printer as the ink nozzles move in relation to a substrate. A printing apparatus includes a platen and a carriage including a number of ink nozzles, the carriage being configured to move across a substrate placed on top of the platen; and a control system configured to adjust the spacing between which ink droplets are fired from ink nozzles of the printer as the ink nozzles move in relation to a substrate.

20 Claims, 6 Drawing Sheets

REDUCING VERTICAL BANDING

BACKGROUND

Inkjet printing is a commonly used printing method used for both large scale printing on banners and other signage items as well as small scale general consumer printing. Inkjet printing generally involves a number of nozzles configured to eject ink onto a substrate such as paper. The nozzles are part of a print head which is often integrated with an ink cartridge. The ink cartridge is typically secured to a movable carriage. The carriage is configured to move across a substrate being fed through the printer. As the carriage moves across the substrate, the ink nozzles will fire at specific times in order to create the appropriate image on the substrate. Such printing methods often create a problem referred to as vertical banding. Vertical banding is the appearance of undesired light and dark lines along the direction in which a substrate is fed into the printer.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
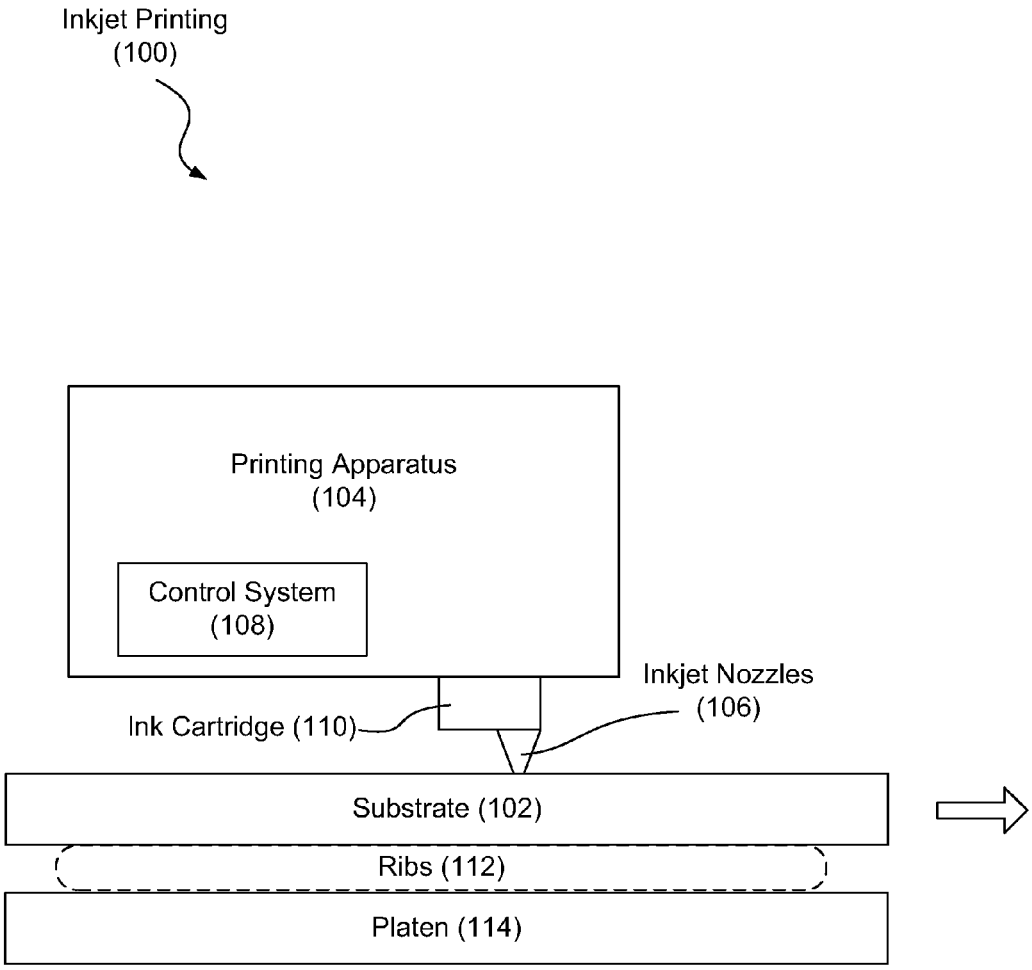
FIG. 1 is diagram showing illustrative inkjet printing principles, according to one embodiment of principles described herein.

As mentioned above, various printing methods often create a problem referred to as vertical banding. Vertical banding is the appearance of undesired light and dark lines along the direction in which a substrate is fed into the printer. In light of this and other issues, the present specification discloses methods and systems for vertical banding reduction.

One cause of vertical banding is the variation in distance between the nozzles of the print head and the substrate. The substrate is typically supported by a number of vertical ribs. The ribs reduce the surface contact area which the substrate makes with the platen. Thus, the substrate is subject to less friction and is able to move through the printer relatively smoothly. As the substrate is typically a flexible material such as paper, the substrate will tend to dip a little bit in between the ribs. Thus, as the carriage moves across the substrate, the distance between the substrate and the nozzles is greater when the nozzles are between ribs than when the nozzles are directly above a rib.

According to certain illustrative embodiments, a control system associated with a printer may be configured to compensate for the dot placement error caused by the variation in distance between the nozzles and substrate by adjusting the spacing between subsequent ink nozzle firings as the ink nozzles move along the substrate. Various compensation profiles may includes, but are not limited to, inverse compensation profiles, linear compensation profiles, and random compensation profiles.

Through use of a method of system embodying principles described herein, the vertical banding of a printed image may be reduced. Additionally, the various compensation modes may be selected and engaged or disengaged by the user at will. Furthermore, the vertical banding may be reduced without producing unwanted side effects during printing.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Throughout this specification and in the appended claims, the term "ink" is to be broadly interpreted as any fluid capable of being ejected from an ink nozzle. Ink may be dyed specific colors to print an intended image onto a substrate.

Throughout this specification and in the appended claims, the term "pen" is to be broadly interpreted as a set of ink nozzles of a particular color. A pen may employ any type of drop-on-demand printing method such as inkjet printing or piezo-electric printing methods. An ink cartridge may include one or more pens.

Referring now to the figures, FIG. 1 is a diagram showing an illustrative apparatus for inkjet printing (100). According to certain illustrative embodiments, a printing apparatus (104) may include a control system (108) and an ink cartridge (110) having a number of inkjet nozzles (106). The printing apparatus (104) may be configured to move a substrate (102) past the nozzles (106) as ink is ejected. Additionally or alternatively, the printing apparatus may be configured to move the ink cartridge (110) and nozzles (106) with respect to the substrate (102) as the ink is ejected.

The control system (108) may include components of a standard physical computing system such as a processor and a memory. The memory may include a set of instructions that cause the processor to perform certain tasks related to the printing of images. For example, the control system (108) may manage the various mechanical components within the printing apparatus (104). Additionally, the control system (108) may convert the image data sent from a computing system to a format which is readily usable by the printing apparatus (104). In some embodiments, the control system may be integrated into the printer itself. Additionally or alternatively, the printer may be controlled by a control system communicatively coupled to the printer. For example, the printer may be connected to a desktop computing system or a laptop computing system via a (Universal Serial Bus) connection.

The ink cartridge (110) may be designed to support several ink pens. As the ink cartridge (110) moves with respect to the substrate (102) and/or the substrate (102) moves underneath the ink cartridge (110), the control system (108) may send a signal to the appropriate inkjet nozzle (106) attached to the ink pens of the ink cartridges (110) to eject an ink droplet. Ink droplets are ejected in a specific pattern so as to create a desired image on substrate (102).

The inkjet nozzles (106) may be configured to eject ink onto the substrate (102) through a variety of methods. One method, referred to as thermal inkjet printing, includes a small ink chamber containing a droplet of ink. A heating resistor is used to heat the ink chamber to a specific temperature when an electric current is applied. Due to various physical properties, this heating increases the pressure inside the small ink chamber and propels the droplet out of the nozzle (106) and onto the substrate (102). The void in the chamber then draws in more ink from a main ink chamber. The control system (108) may be used to cause electric current to flow through the appropriate heating resistors at the appropriate times.

The substrate (102) which is fed through a printer may be of a variety of materials. The types of materials fed through a printer may be paper based and vinyl based. The substrate (102) is typically fed underneath the ink nozzles (106) on top of a platen (114) which includes a number of ribs (112). The ribs (112) lift the substrate (102) slightly above the platen (114), reducing the friction experienced by the substrate (102) as it moves underneath the ink nozzles (106). Due to the flexibility of the substrate (102), it will tend to dip slightly between the ribs (112). This occurrence is referred to as cockle.

Figure 2A:
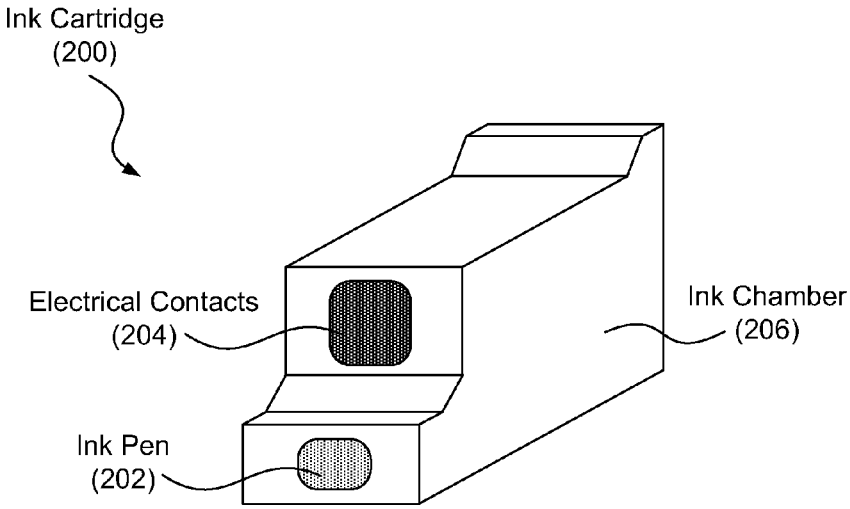
FIG. 2A is a diagram showing a perspective view of an illustrative ink cartridge, according to one embodiment of principles described herein.

FIG. 2A is a diagram showing a perspective view of an illustrative ink cartridge (200). According to certain illustrative embodiments, the ink cartridge may include at least one ink pen (202), a group of electrical contacts (204) and an ink chamber (206). Ink cartridges may be designed in a variety of shapes and sizes to fit the specific printers for which they are designed. In some cases, an ink cartridge (200) may contain an ink chamber (206) for only one color. In other cases, an ink cartridge (200) may include a number of ink chambers (206) each storing a different ink color.

The ink pen (202) may include the actual physical nozzles wherefrom ink is ejected onto the substrate. Each physical nozzle may be addressed through a number of select lines. Additionally, each physical nozzle may be connected to a fire line. The fire line is an electrical line configured to carry an electrical signal of sufficient power to heat a resistor associated with the physical nozzle. The resistor may be configured to get hot enough to propel a small droplet of ink from a small interim ink chamber associated with the nozzle. Upon ejecting the ink from the interim chamber, the void in the chamber draws more ink from the main ink chamber (206).

The various electrical lines such as data lines, select lines, and fire lines may interface with the printer through a group of electrical contacts (204) on the exterior of the ink cartridge (204). The electrical contacts (204) may be made of an electrically conductive material such as a metallic material. The electrical contacts may be designed to make contact with another set of geometrically similar electrical contacts on a carriage associated with the printer. Thus, an electrical signal may travel from the printer, to an electrical interface on the carriage, through the electrical contacts (204), and ultimately to the ink pen (202).

Figure 2B:
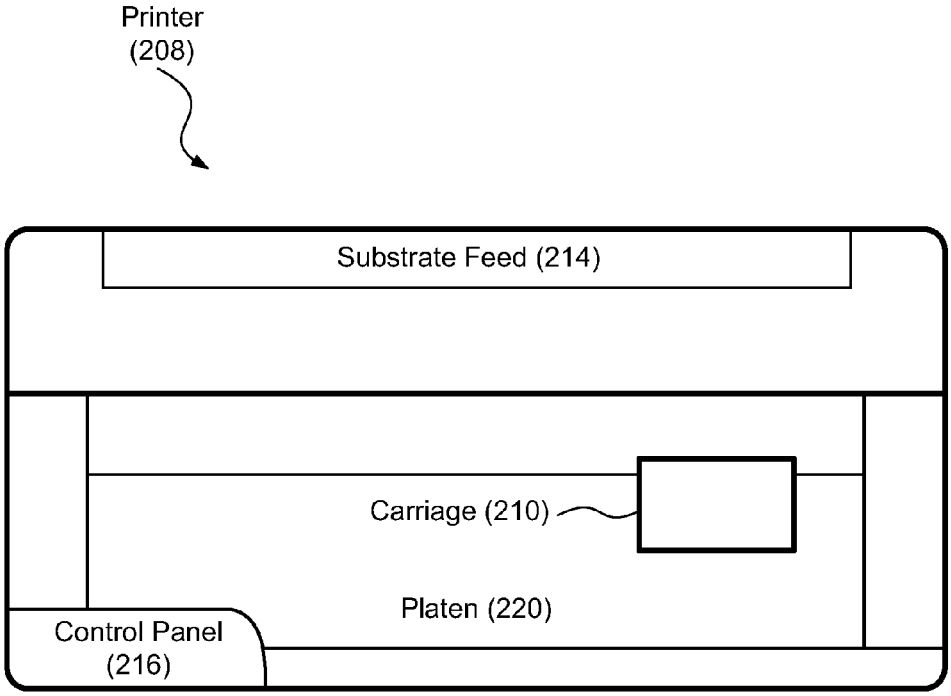
FIG. 2B is diagram showing a top view of an illustrative inkjet printer, according to one embodiment of principles described herein.

FIG. 2B is diagram showing a top view of an illustrative inkjet printer (208). According to certain illustrative embodiments, the printer may include a carriage (210) having electrical contacts (212) disposed thereon. The printer (208) may also include a substrate feed (214) and a control panel (216). A typical printer (208) may have a type of hood to cover the carriage (210) from view. The hood may be lifted to replace ink cartridges or perform other maintenance tasks on the printer (208).

The carriage may be configured to securely hold the ink cartridges (200) used by the printers. In some embodiments, a printer (208) may require one ink cartridge which holds ink pens for both black ink and colored inks. In some cases, the printer (208) may be designed to use a separate ink cartridge for black ink and colored inks. The carriage (210) may be designed to securely hold the ink cartridges in a manner such that the ink pen (202) of the ink cartridge (200) may be placed within close proximity to a substrate. In this configuration, the carriage (210) is movable along the position under which the substrate will pass. Thus as the carriage (210) moves along, the ink cartridges (200) may receive signals indicating when to fire specific nozzles to form the desired image.

The signals indicating which nozzles are to fire at what time may be received through the electrical interface of the carriage (210). The electrical interface includes the electrical contacts which, as mentioned above, are positioned in a manner similar to the electrical contacts of the ink cartridges (200).

The substrate feed (214) may be a structure configured to receive a substrate to be used for printing. The printer (208) may pull the substrate along the platen (220) through the printer at the desired speed in order to allow the ink to be printed in the proper locations.

A control panel (216) may be used to allow a user to configure the printer and make use of various features and options which are available with the printer (208). For example, a user may indicate a compensation profile through the control panel (216). As mentioned above, the various compensation profiles may be used to reduce vertical banding.

Figure 3A:
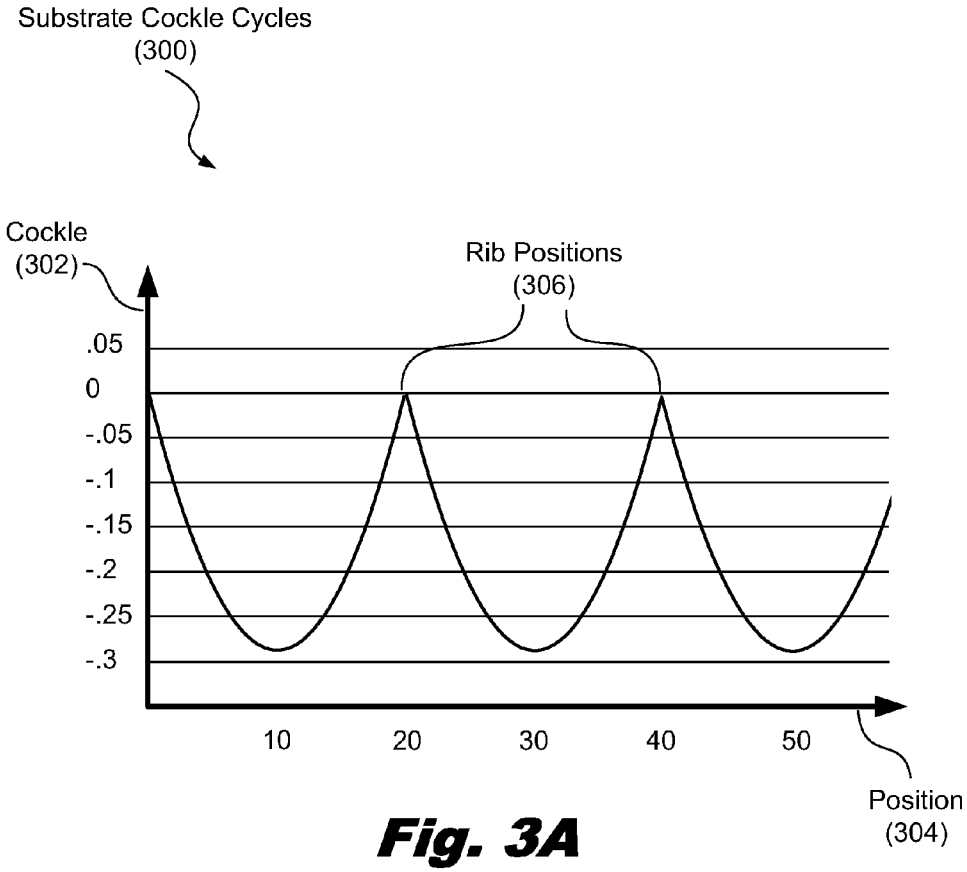
FIG. 3A is a diagram of an illustrative graph showing substrate cockle cycles, according to one embodiment of principles described herein.

FIG. 3A is a diagram of an illustrative graph showing substrate cockle cycles (300). The vertical axis of the graph represents the substrate cockle (302) in millimeters (mm). The horizontal axis of the graph represents the position (304) along the platen (308) in millimeters. The positions (304) in which the substrate cockle (302) is at zero correspond to the positions (306) of the cockles ribs (310).

A platen (308) is the flat material on which a substrate (312) moves along in order to be printed upon. The graph shows the position (304) along the scan axis of a printer. The scan axis is perpendicular to the direction in which the substrate (312) moves through the printer. As mentioned above, the platen (308) includes a number of ribs (310) to support the substrate (312). The ribs (310) lift the substrate (312) slightly off of the platen (308), greatly reducing the contact area between the substrate (312) and the platen (308). This reduces the friction between the substrate (312) and the platen (308), allowing the substrate (312) to be easily fed through the printer and control the expansion of the substrate along the upper vertical axis.

Figure 3B:
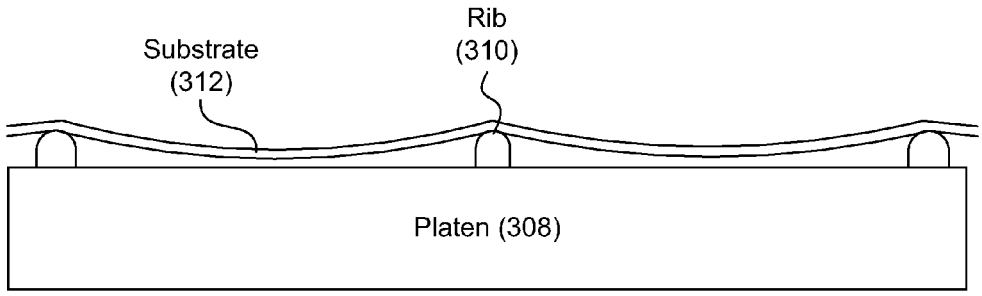
FIG. 3B is a diagram showing an illustrative substrate on top of ribs, according to one embodiment of principles described herein.

In this configuration, the ribs (310) are placed every 20 mm. The graph illustrates the cockle (302) as a function of position (304) along the platen (308). A cockle value of zero indicates that there is no cockle (302) in the substrate (312). When there is no cockle (302), the substrate is as high as the ribs (310). As the position (304) moves away from the ribs (310), the cockle value goes negative. That is, the location of the substrate (312) is below the height of the ribs (310). Thus, at positions along the platen (308) where the ribs (310) are located, the cockle (302) is zero. At positions along the platen (308) in between the ribs (310), the cockle (302) approaches −0.3 mm FIG. 3B is a diagram showing an illustrative side view of a substrate (312) on top of ribs (310). According to certain illustrative embodiments, the substrate (312) rests on top of a number of ribs (310). At the positions along the platen (308) in between the ribs (310), the flexible substrate (312) tends to dip down a little bit.

Figure 4:
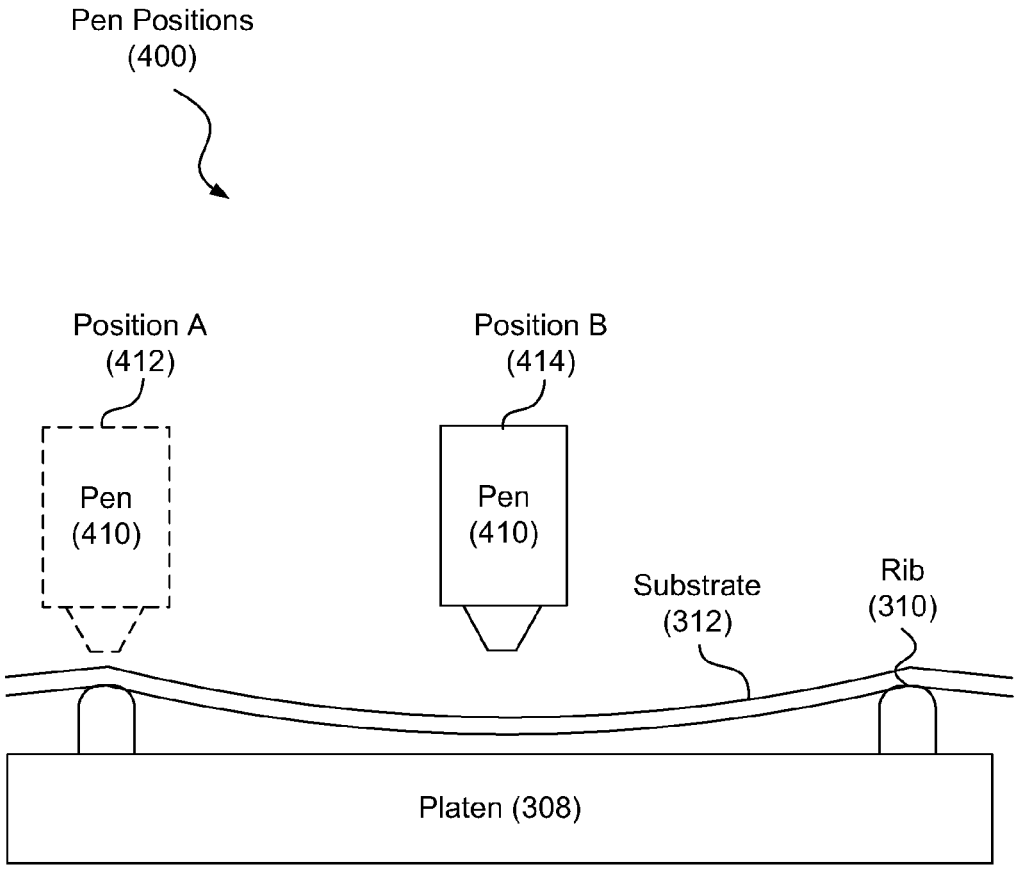
FIG. 4 is a diagram showing illustrative pen positions above a substrate, according to one embodiment of principles described herein.

FIG. 4 is a diagram showing illustrative pen positions (400) above a substrate. According to certain illustrative embodiments, a pen (410) may move across the substrate (312). The pen includes a number of ink nozzles configured to fire droplets of ink as the pen moves across the substrate (312). The ink droplets are fired from the nozzles at specific times when the ink nozzles are above specific locations in order to print the desired image onto the substrate (312). The ink cartridge and the pen may be two different devices.

As mentioned above, one cause of vertical banding is the variation of distance between the pen (410) and the substrate (312). For example, when the pen (410) is in position A (412), the pen (410) is directly above a rib (310). When the pen is in position B (414), the pen is between ribs (310). Thus, the distance between the pen and the substrate (312) is greater when the pen (410) is at position A then when the pen (410) is at position B (414).

In some cases, the ink droplets may be fired at a slight angle. Thus, the dots created by the ink droplets may not be spaced appropriately as the cockle changes due to the change in position of the ink pen. For example, when the pen (410) is passing position A (414) the distance between the pen (410) and the substrate (312) due to the cockle may cause the dots to be spaced closer to each other than desired. Likewise, when the pen (410) is passing position B (414) the distance between the pen (410) and the substrate (312) due to the cockle may cause the dots to be spaced farther apart than desired. This may cause the appearance of vertical lines along the printed image.

As mentioned above, the present specification discloses a method for reducing vertical banding by adjusting the spacing between the dots placed by the ink nozzles of a printer. The spacing may be adjusted to compensate for the spacing variation caused by the substrate cockle.

Figure 5A:
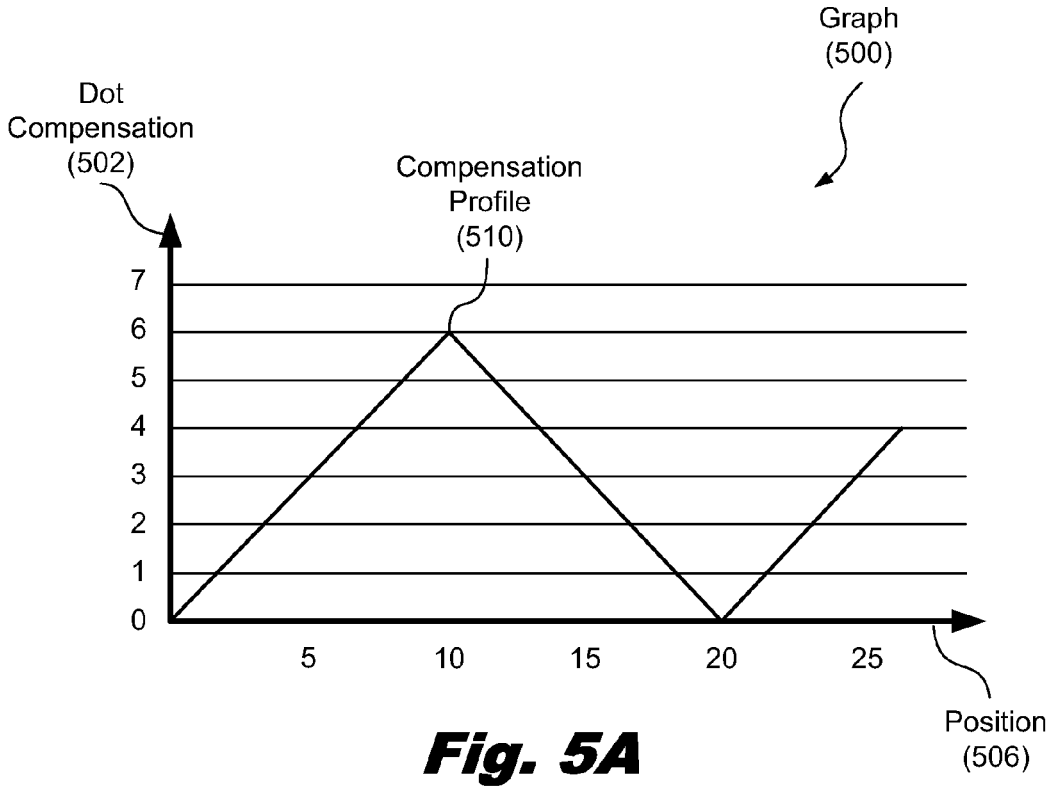
FIG. 5A is a diagram showing an illustrative graph showing a compensation profile, according to one embodiment of principles described herein.

FIG. 5A is a diagram showing an illustrative graph (500) of a compensation profile. According to certain illustrative embodiments, the control system of a printer may be configured to use a compensation profile (510) to reduce vertical banding. The compensation profile indicates how much to adjust the spacing between dots as a function of position (506) along the platen. The vertical axis represents the dot compensation (502) and the horizontal axis represents the position (506) along the platen in millimeters.

The values illustrated along the vertical axis do not necessarily represent any specific number of dots created by ink droplets fired over a specific distance. Rather, the larger the number, the more dots are fired from the ink nozzles over a specific distance. Thus, higher dot compensation (502) represents an increase in the spacing between ink droplet fired onto the substrate.

The compensation profile (510) illustrated in FIG. 5A shows an increase in dot compensation between a position at 0 mm and 10 mm. Thus, as the carriage supporting the ink pen moves along this position, the spacing at which the ink nozzles are fired is increased. The dot compensation between the position at 10 mm and a position at 20 mm is shown decreasing. Thus, as the pen moves along this position, the spacing at which the ink nozzles is decreased.

The spacing between subsequent nozzle firings may be adjusted through a variety of methods. In some embodiments, the spacing between subsequent nozzle firings may be adjusted by increasing or decreasing the rate at which subsequent nozzles are fired. As the rate at which the ink nozzles are fired increases, the spacing between firings decreases. Conversely, as the rate at which the ink nozzles are fired decreases, the spacing between firings increases.

In some embodiments, the spacing between subsequent nozzle firings may be adjusted by altering the speed at which the carriage supporting the ink nozzles moves in relation to the substrate. As the speed at which the carriage moves increases, the spacing between subsequent nozzle firings also increases. Conversely, as the speed at which the carriage moves decreases, the spacing between subsequent nozzle firings also decreases. In some cases, the speed may be adjusted by adding and removing delays to the movement of the carriage.

Various compensation profiles may be designed and implemented to fit the needs of specific printers. For example, various printers may have different distances between ribs. Additionally, various substrate materials may be of differing flexibility. Consequently, different substrate materials may have different cockle profiles. A few examples of different compensation profiles (510) will now be discussed. The following discussion of compensation profiles (510) is not an exhaustive list of compensation profile types or compensation profile designs.

Figure 5B:
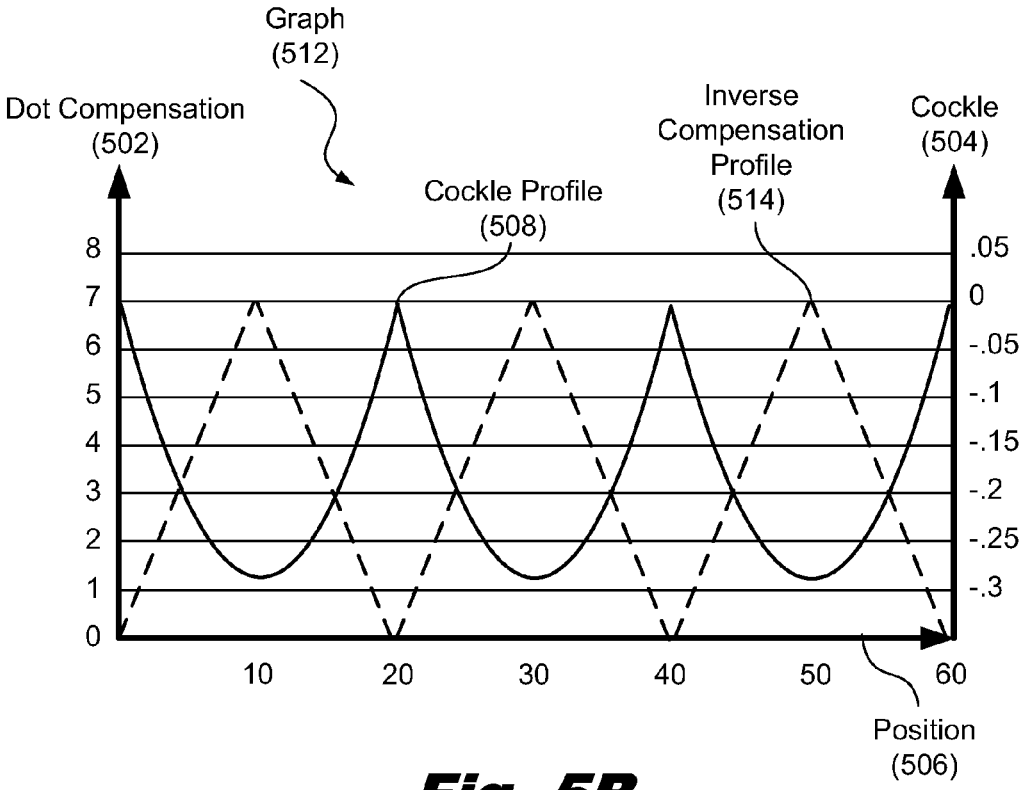
FIG. 5B is a diagram showing an illustrative graph showing an exact compensation profile, according to one embodiment of principles described herein.

FIG. 5B is a diagram showing an illustrative graph (512) showing an inverse compensation profile (514) in relation to a cockle profile (508). The horizontal axis of the graph represents the position (506) along the platen. The left vertical axis represents the dot compensation (502) and the right vertical axis represents the substrate cockle (504). The solid line illustrates the cockle profile (508) and the dotted line represents the inverse compensation profile.

According to certain embodiments, the compensation profile (514) may be designed to directly compensate for changes in the cockle. At the positions where the cockle is the greatest (e.g. 10 mm, 30 mm, and 50 mm), the compensation profile indicates the highest level of dot compensation. Thus, as the distance between the pen and the substrate at the high cockle positions generally causes greater spacing between the dots, the control system of the printer may compensate by reducing the spacing between the firing of the ink nozzles. Conversely, at the positions above the ribs wherein the pen is closer to the substrate (e.g. 20 mm, 40 mm, and 60 mm), the control system may not perform any compensation.

Figure 6A:
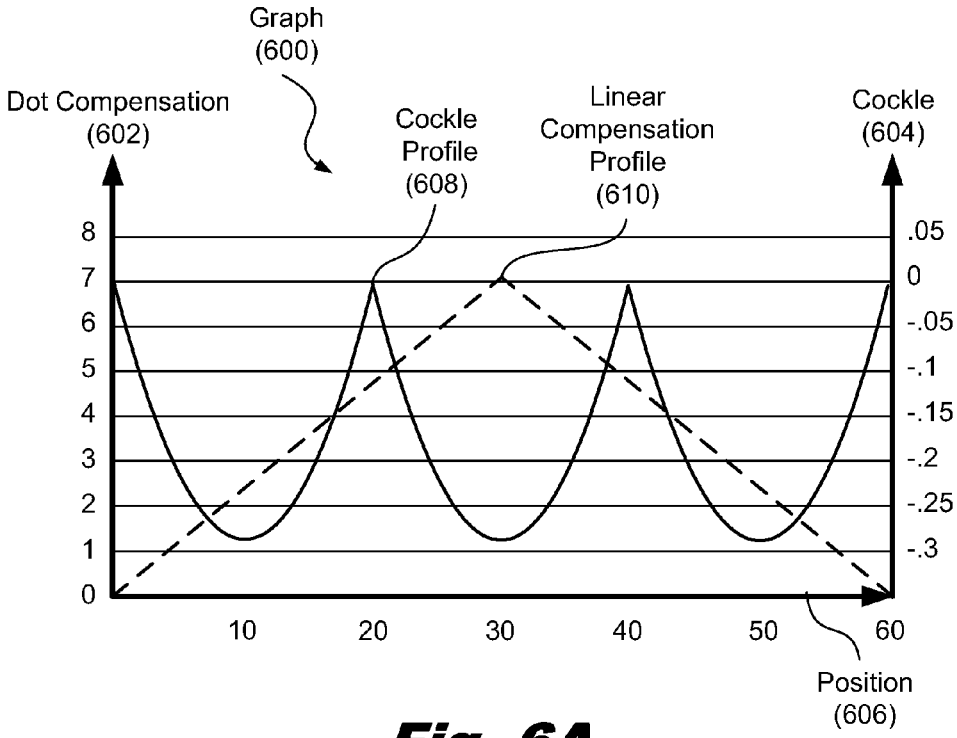
FIG. 6A is a graph showing an illustrative linear compensation profile in relation to a substrate cockle profile, according to one embodiment of principles described herein.

FIG. 6A is a graph (600) showing an illustrative linear compensation profile (610) in relation to a substrate cockle profile. The horizontal axis of the graph represents the position (606) along the platen. The left vertical axis represents the dot compensation (602) and the right vertical axis represents the substrate cockle (604). The solid line illustrates the cockle profile (608) and the dotted line represents the inverse compensation profile (514).

According to certain embodiments, the compensation profile (610) may be linear. Thus, as the pen moves along the platen, the spacing between subsequent nozzle firings steadily increase and decreases over periods larger than a cockle profile period. This may break the periodic dot placement error caused in part by the substrate cockle. By breaking the periodic dot placement error, the vertical banding seen on the printed image may be reduced. The adjustments made to the spacing may be small enough so as to be unnoticeable to the human eye at standard viewing distances. In some embodiments, the linear compensation profile (610) may span multiple substrate cockle periods.

Figure 6B:
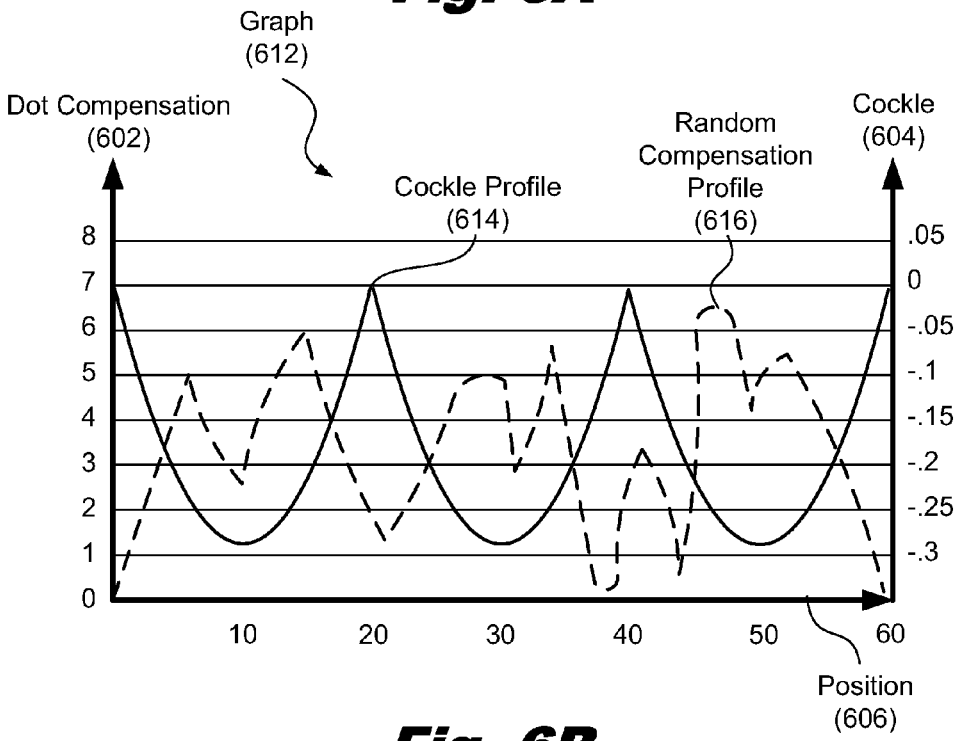
FIG. 6B is a graph showing an illustrative random compensation profile in relation to a substrate cockle profile, according to one embodiment of principles described herein.

FIG. 6B is a graph (612) showing an illustrative random compensation profile (616) in relation to a substrate cockle profile (614). The horizontal axis of the graph represents the position (606) along the platen. The left vertical axis represents the dot compensation (602) and the right vertical axis represents the substrate cockle (604). The solid line illustrates the cockle profile (608) and the dotted line represents the random compensation profile (616).

According to certain embodiments, the compensation profile (610) may be random. Thus, as the pen moves along the platen, the spacing between subsequent nozzle firings may be random. This may break the periodic dot placement error caused in part by the substrate cockle. By breaking the periodic dot placement error, the vertical banding seen on the printed image may be reduced. The adjustments made to the spacing may be small enough so as to be unnoticeable to the human eye at standard viewing distances. Various randomizing functions may be applied to produce the random compensation profile (616).

In sum, through use of a method of system embodying principles described herein, the vertical banding of a printed image may be reduced. Additionally, the various compensation modes may be selected and engaged or disengaged by the user at will. Furthermore, the vertical banding may be reduced without producing unwanted side effects during printing.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for reducing vertical banding of a printed image, the method performed by a control system associated with a printer, the method comprising:

with said control system, adjusting a spacing between which ink droplets are fired from ink nozzles of said printer as said ink nozzles move in relation to a substrate, to thereby compensate for dot placement error associated with variation in distance between the ink nozzles and the substrate.

2. The method of claim 1, in which said spacing is adjusted by altering a rate at which said ink nozzles eject ink droplets.

3. The method of claim 1, in which said spacing is adjusted by altering the speed in which a carriage holding said ink nozzles moves in relation to said substrate.

4. The method of claim 1, in which said spacing is adjusted according to a linear compensation profile.

5. The method of claim 4, in which said linear compensation profile spans multiple substrate cockle periods.

6. The method of claim 1, in which said spacing is adjusted according to a random compensation profile.

7. The method of claim 1, in which said spacing is adjusted according to an inverse compensation profile.

8. The method of claim 7, in which said spacing is adjusted in a manner such that as a distance between said nozzles and said substrate increases, said spacing increases.

9. The method of claim 7, in which said spacing is adjusted in a manner such that as a distance between said nozzles and said substrate increases, said spacing decreases.

10. The method of claim 1, in which a manner in which said spacing is adjusted is controlled by a user interface associated with said printer.

11. A printing apparatus comprising:

a platen;

a carriage comprising a number of ink nozzles, said carriage configured to move across a substrate placed on top of said platen; and a control system configured to:

adjust a spacing between which ink droplets are fired from ink nozzles of said printer as said ink nozzles move in relation to a substrate, to thereby compensate for dot placement error associated with variation in distance between the ink nozzles and the substrate.

12. The printing apparatus of claim 11, in which said spacing is adjusted by altering a rate at which said ink nozzles eject ink droplets.

13. The printing apparatus of claim 11, in which said spacing is adjusted by altering a speed at which said carriage moves in relation to said substrate.

14. The printing apparatus of claim 11, in which said spacing is adjusted according to a linear compensation profile.

15. The printing apparatus of claim 14, in which said linear compensation profile spans multiple substrate cockle periods.

16. The printing apparatus of claim 11, in which said spacing is adjusted according to a random compensation profile.

17. The printing apparatus of claim 11, in which said spacing is adjusted in a manner such that as a distance between said nozzles and said substrate increases, said spacing increases.

18. The printing apparatus of claim 11, further comprising a user interface, said user interface configured to allow a user to alter a manner in which said spacing is adjusted.

19. A control system capable of reducing vertical banding in a printed image, the control system comprising:

a processor and a memory, said processor configured to:

adjust a spacing in which ink droplets are fired by nozzles of a printer communicatively coupled to said control system, said ink droplets being fired onto a substrate as said ink nozzles move in relation to said substrate, to thereby compensate for dot placement error associated with variation in distance between the ink nozzles and the substrate.

20. The system of claim 19, in which said spacing is adjusted by altering one of: a rate at which said nozzles eject ink droplets and a speed in which a carriage holding said nozzles moves in relation to said substrate.

* * * * *